United States Patent [19]

Scheffler

[11] 3,945,513

[45] Mar. 23, 1976

[54] GRAVITY DISCHARGE FURNACE FOR HEATING PRODUCTION PARTS

[75] Inventor: Friedrich Scheffler, Remscheid, Germany

[73] Assignee: AEG-Elotherm GmbH, Remscheid, Germany

[22] Filed: Aug. 28, 1974

[21] Appl. No.: 501,442

[30] Foreign Application Priority Data

Sept. 1, 1973 Germany ..... 2344234

[52] U.S. Cl. ..... 214/23; 198/220 A; 214/18 R; 432/126; 432/134

[51] Int. Cl.[2] ..... F27B 9/38

[58] Field of Search ..... 214/18 R, 23–25; 432/126, 134; 198/220 A, 220 BA

[56] References Cited

UNITED STATES PATENTS 2,815,135 12/1957 Kullmar ..... 214/18 R 3,051,812 8/1962 Gschwender ..... 214/23 X 3,847,291 11/1974 Seulen et al. ..... 214/27

*Primary Examiner*—Robert G. Sheridan

*Attorney, Agent, or Firm*—Cushman, Darby & Cushman

[57] ABSTRACT

A at discharge oven for heating a large number of production parts which pass through the oven on a conveyor belt and are pushed by a pushing mechanism mounted att the oven, evidence whereby the conveyor belt is attached to a swingable beam and a vibrator is mounted for exerting a force on the belts and parts thereon which has a component in a direction perpendicular to the direction of part movement through the oven.

6 Claims, 3 Drawing Figures

GRAVITY DISCHARGE FURNACE FOR HEATING PRODUCTION PARTS

The invention relates to a gravity-discharge furnace for heating production parts.

Furnaces of this sort are commonly used, for example, in the mass production of forgings for heating up steel ingots before forging to a forging temperature, which for steel is about 1,150° – 1,280° C., while the parts are intermittently advanced through the furnace. In one type of conventional furnace, the parts are pushed through the furnace. However, in this type of furnace, as the number of parts increases, the pushing forces that are required to be exerted by the pushing mechanism upon advancement of the production parts through the furnace become very large due to the friction between the parts and the conveyor belt. Thereby, they make a correspondingly great demand on the pushing mechanism.

Such frictional forces are important even during periods when the parts are at rest, i.e. between successive pushing movements of the mechanism, and they hinder the thermal expansion of the heated parts. The result is often that the ingots stick together or weld together in the high temperature region of the furnace and thus cause a disturbance in the fixed-cycle operation. It is then often impossible to separate the two parts that have stuck or welded together, and the parts must be scrapped.

It is also already known that it is advantageous that the conveyor belt which passes through the furnace in the conveyor direction be bendable in different directions, so that the parts arranged in proximity strike against one another at constantly changing angles during transport, and thus make difficult welding or adhesion of one or more parts to one another. A problem in this approach is that the required pushing forces that the pushing mechanism must exert are increased.

Another type of furnace is the gravity-discharge furnace, in which the parts are placed on a level conveyor belt, which in turn is hinged to a beam so that it swings, and is connected to a vibrator. The vibrator exerts oblique thrusts upon the parts being transported on the conveyor belt. These thrusts lift the parts from the conveyor belt and speed them in the direction of transport. Such mechanisms have one principle disadvantage; the transport velocity depends, among other factors, on the bulk of the parts. It is therefore difficult to maintain the constant transit times in the furnace that are necessary for attaining exact forging temperatures.

The object of this invention is to produce a gravity-discharge furnace with an ingot pusher, intended to push the production parts, largely consisting of steel ingots, that are supported on slipways and arranged in a columnar row, in a forward direction through the furnace, and which — under otherwise equal conditions — requires a lesser transporting force; i.e. in the time between two forward movements, there is less resistance to the expansion of the column of parts than is the case in existing gravity-discharge furnaces.

This object is fulfilled by gravity discharge furnaces according to the invention — described in greater detail below — in that the conveyor belt is attached to a beam in such a way that it swings, and is also connected with a vibrator that acts upon the conveyor belt with an acceleration of the vibratory motion and has a component that is arranged perpendicalarly to the direction of transport of the parts. With this construction it is possible to transport the parts with substantial freedom from frictional forces between the parts and the vibrating conveyor belt.

According to a particularly advantageous aspect of this invention, the pushing mechanism is also arranged on the swinging beam.

In another advantageous aspect of this invention, the vibrator is attached to the beam and an additional vibrator is connected with the pushing mechanism and impresses an acceleration in the vibratory motion upon this pushing mechanism in the direction of the extension of the conveyor belt, whereby the accelerators of the vibrators are of the same frequency and have a fixed phase relationship.

In devices according to the invention, so-called imbalance-vibrators, that are driven by an electric motor are used preferably.

In the following, the invention is described in detail with reference to the drawings, with FIG. 1 showing a first preferred embodiment of the gravity-discharge furnace of the invention in cross-section.

Figure 1:
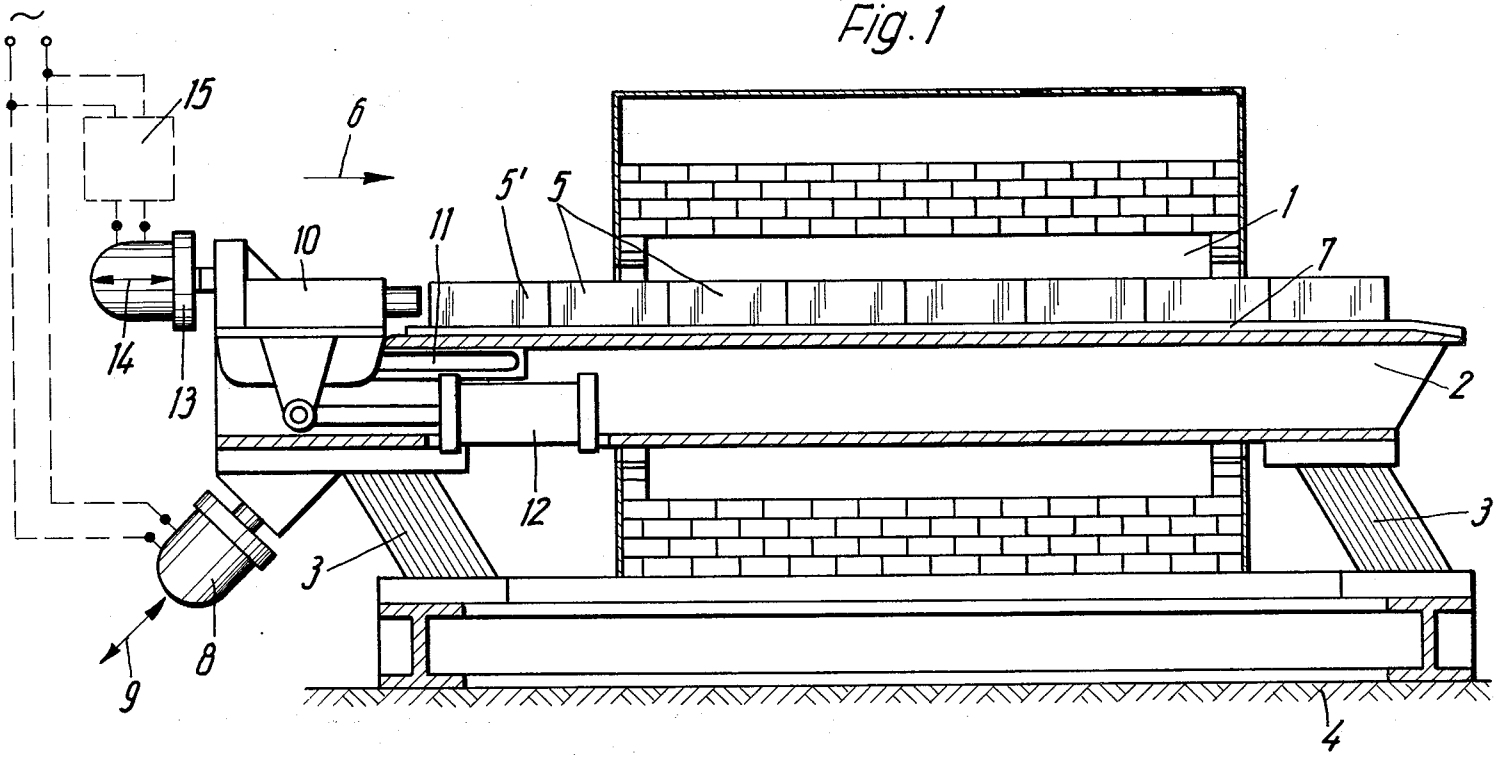

Referring to FIG. 1, a swing beam 2 extends through the furnace space 1 of a conventional fuel-heated oven. Swing beam 2 is connected with the foundation of the furnace 4 by means of flexible supports 3. A slipway 7 is mounted on the swing beam 2, to support the steel ingots 5 that are to be heated and which are to be pushed in the forward direction, indicated by arrow 6 through furnace space 1. Also attached to the swing beam 2 is a main vibrator 8, which impresses an acceleration of vibratory motion on the swing beam 2 in the direction of the arrow 9. This motion has both vertical and horizontal components. The acceleration component in the vertical direction is preferably equal to or greater than 5% of the acceleration due to gravity.

An ingot pusher 10, arranged on the rails 11 of the swing beam 2 and movable in the forward direction, is connected on the one hand with a pneumatic setting mechanism 12 that serves as the ingot pusher actuator, and on the other hand, with an auxiliary vibrator 13, which exerts an acceleration of vibratory motion on the ingot pusher in the direction of the slipway extension, as indicated by the arrow 14. Both vibrators 8 and 13 are fed by the same alternating-current source, whereby the phase relationship of the oscillation of the auxiliary vibrator 13 to that of the main vibrator 8 is regulated by a phase changer 15 in the power line connected to the auxiliary vibrator 13. Vibrators 8 and 13 are conventional imbalance-vibrators.

The gravity-discharge furnace of FIG. 1 operates as follows:

In the position of the ingot pusher 10 shown in FIG. 1, the ingot 5′, located just outside the furnace, has been moved into the position shown in FIG. 1 by a movement vertical to the forward direction of transport 6, e.g., lateral to a chute (not shown in the figure). During operation, the main vibrator 8 operates continuously. Ingot pusher 10 when activated by the pneumatic setting mechanism 12 has a significantly lesser resistance to overcome to push the ingot column in the forward direction when the main vibrator 8 is turned on, than when it is turned off. This effect is further strengthened when the auxiliary vibrator 13 is switched on, impressing an acceleration of vibratory motion on the ingot pusher in the direction of the ingot slipway extension, this acceleration assisting the thrust of the ingot pusher 10. For certain phase relationship of the oscillations of vibrator 8 and 13 as can be easily determined for any specific installation, there is an optimum which can be regulated easily by shifting the conventional phase changer 15.

However, even in the time between the separate forward movements, during which the main vibrator 8 remains switched on, the ingot columns can expand more easily than would be the case without the vibration of the main vibrator 8. The strong pushing forces that otherwise would appear as a result of the high degree of friction between the ingots and the slipway upon thermal expansion of the ingot columns between neighboring ingots are largely avoided.

Figure 2:
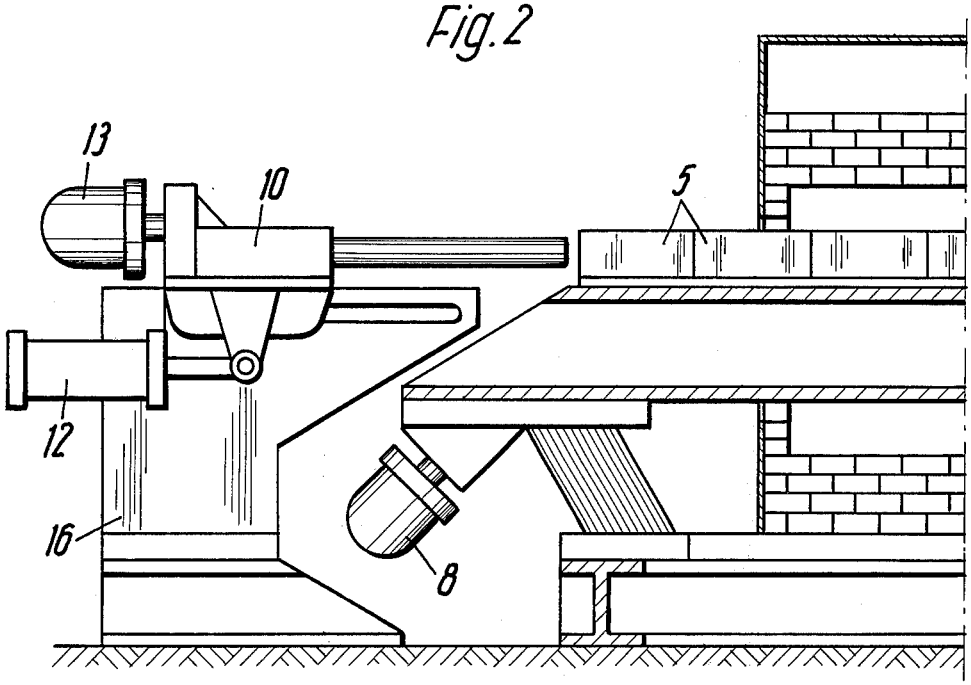
FIG. 2 shows a partial longitudinal cross section of a second embodiment.

FIG. 2 shows a partial longitudinal cross-section of another preferred embodiment of the gravity-discharge furnace of this invention, which differs from FIG. 1 in that the ingot pusher 10, along with the auxiliary vibrator 13 and the hydraulic setting mechanism 12 that drives it, are mounted not on the swing beam 2 itself, but rather, by means of their own pedestal, with the furnace base. This embodiment is especially suited to heavy ingots, for which the already necessarily heavy swing beam construction is preferably not weighted down even more by addition of further elements of the device.

In the case of the embodiments of FIGS. 1 and 2, if the action of the main vibrator 8 is sufficient, the auxiliary vibrator 13 can, be eliminated.

Figure 3:
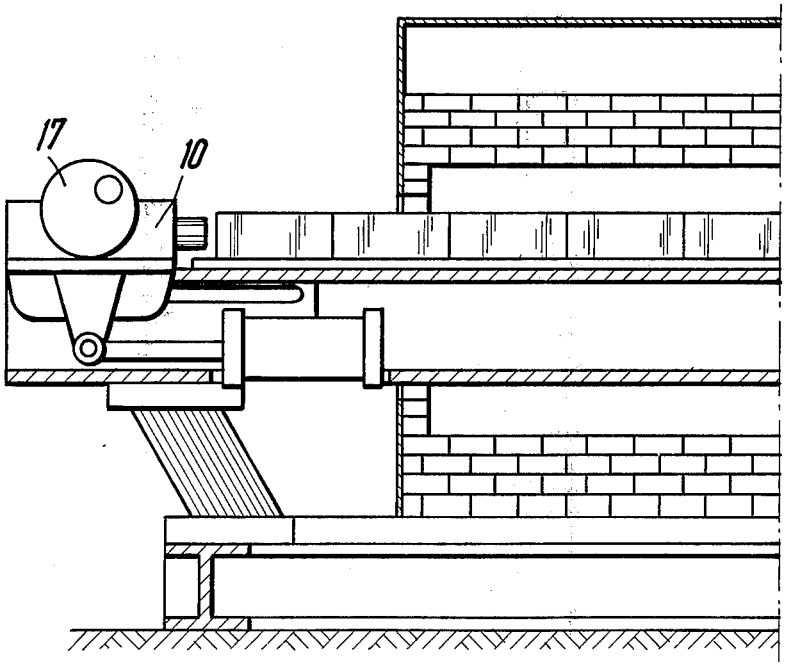
FIG. 3 shows a third embodiment in partial cross section.

In FIG. 3, another advantageous embodiment of the gravity-discharge furnace of the invention is represented in partial longitudinal cross-section. It differs from the variation of FIG. 1 essentially in that the main vibrator and the auxiliary vibrator are replaced by a single imbalance-vibrator 17, connected with the ingot pusher 10. This vibrator imparts an acceleration of vibratory motion to the swing beam 2 with a component perpendicular to the slipway through the slide of the ingot pusher 10 on the swing beam 2. It also causes the ingot pusher to swing in its slide, i.e. in the direction of the parts-slipway extension.

Many changes and modifications on the above described embodiment of the invention can of course be carried out without departing from the scope thereof. Accordingly, that scope is intended to be limited only by the scope of the appended claims.

I claim:

1. In a gravity-discharge oven for heating a large number of production parts, which pass through the oven along slipway on which they lie, the parts being pushed through the oven by means mounted at the entrance to the said oven, for exerting a force upon the nearest part on the slipway to push all of the parts, as a column of parts over a stretch whose length is determined by the stroke of the pushing mechanism, the improvement including a beam, means for attaching said slipway to said beam in such a way that said beam swings, and a vibrator that acts upon said slipway with an acceleration of vibratory motion that has a component perpendicular to the direction of transport of the parts.

2. In a gravity-discharge furnace as in claim 1, the further improvement wherein the amplitude of the component of the acceleration of vibratory motion pependicular to the extension of the parts-slipway is greater than or equal to 5% of the acceleration due to gravity.

3. A gravity-discharge furnace as in claim 1, further including means for attaching said pushing means to said swing beam.

4. A gravity-discharge furnace as in claim 1, wherein said pushing means includes a pneumatic cylinder.

5. A gravity-discharge furnace as in claim 1, including means for fastening said vibrator onto the swing beam and further including an additional vibrator connected with said pusher, means for impressing an acceleration in vibratory motion on the swing beam in the direction of extension of said slipway, whereby the accelerations in vibratory motion of the vibrators have the same frequency and a predetermined phase relationship to one another.

6. A gravity-discharge furnace as in claim 1, wherein said vibrator includes an imbalance-vibrator connected to the ingot pusher.

* * * * *